US007510097B2

(12) United States Patent
Spindel et al.

(10) Patent No.: US 7,510,097 B2
(45) Date of Patent: Mar. 31, 2009

(54) FRAME STRUCTURE FOR A COLLAPSIBLE BOX WITH TOP ACCESS, SIDE ACCESS AND INTERCONNECTED VERTICAL STACKING

(76) Inventors: Martin Spindel, 257 W. 91st St., #2E, New York, NY (US) 10024; Nadine Cino, 257 W. 91st St., #2E, New York, NY (US) 10024

( * ) Notice: Subject to any disclaimer, the term of this patent is extended or adjusted under 35 U.S.C. 154(b) by 0 days.

(21) Appl. No.: 11/981,084

(22) Filed: Oct. 31, 2007

(65) Prior Publication Data

US 2008/0061059 A1 Mar. 13, 2008

Related U.S. Application Data

(63) Continuation of application No. 11/495,809, filed on Jul. 28, 2006, now Pat. No. 7,337,914, which is a continuation-in-part of application No. 11/452,146, filed on Jun. 13, 2006, which is a continuation of application No. 10/245,643, filed on Sep. 16, 2002, now Pat. No. 7,083,061.

(51) Int. Cl.

| | |
|---|---|
| ***B65D 6/18*** | (2006.01) |
| ***B65D 6/34*** | (2006.01) |
| *B65D 88/52* | (2006.01) |
| *B65D 90/00* | (2006.01) |

(52) U.S. Cl. ..... 220/6; 220/1.5; 220/651; 217/15; 217/47; 217/57

(58) Field of Classification Search ..... 220/1.5, 220/6, 651, 4.28, 7; 217/15, 38, 47, 59; 229/117.03, 229/117.04, 117.07

See application file for complete search history.

(56) References Cited

U.S. PATENT DOCUMENTS 1,040,580 A * 10/1912 Roseboom ..... 217/15
1,091,391 A * 3/1914 Romans ..... 217/15
3,363,800 A * 1/1968 Anderson ..... 220/4.01
3,527,339 A * 9/1970 Cipolla ..... 206/290
3,796,342 A * 3/1974 Sanders et al. ..... 220/6
4,577,772 A * 3/1986 Bigliardi ..... 220/1.5
4,630,746 A * 12/1986 Fortenberry ..... 220/6
4,646,928 A * 3/1987 Ono et al. ..... 220/6
4,679,242 A * 7/1987 Brockhaus ..... 383/4
4,684,043 A * 8/1987 Foster et al. ..... 222/386
4,693,387 A * 9/1987 Stonier ..... 220/6
4,746,059 A * 5/1988 Jackson ..... 229/117.01
5,038,953 A * 8/1991 Radar ..... 220/6
5,064,068 A * 11/1991 Sheng ..... 206/425
5,090,614 A * 2/1992 Kupersmit ..... 229/117.04
5,107,639 A * 4/1992 Morin et al. ..... 52/71
5,671,858 A * 9/1997 Hsu ..... 220/9.2
5,862,931 A * 1/1999 Cox et al. ..... 220/6
6,036,041 A * 3/2000 Chern ..... 220/6
6,089,394 A * 7/2000 Ziglar ..... 220/6
6,170,689 B1 * 1/2001 Flesher et al. ..... 220/7

(Continued)

*Primary Examiner*—Anthony D Stashick
*Assistant Examiner*—Niki M Eloshway
(74) *Attorney, Agent, or Firm*—Pryor Cashman LLP; Barry E. Negrin, Esq.

(57) ABSTRACT

A collapsible box with a pair of opposed, hinged sidewalls in which a lightweight frame structure holds the sidewall in a vertical orientation during assembly and provides load-bearing strength. The frame structure and sidewalls fold over one another, and lie substantially flat, when said box is collapsed.

5 Claims, 9 Drawing Sheets

U.S. PATENT DOCUMENTS 6,223,400 B1 * 5/2001 Lenack ..... 24/306
6,691,885 B2 * 2/2004 Brown ..... 220/7
7,083,061 B2 * 8/2006 Spindel et al. ..... 220/6
7,121,242 B2 * 10/2006 Inui et al. ..... 123/90.33

* cited by examiner

FRAME STRUCTURE FOR A COLLAPSIBLE BOX WITH TOP ACCESS, SIDE ACCESS AND INTERCONNECTED VERTICAL STACKING

CROSS REFERENCE TO RELATED APPLICATIONS

This application is a continuation of U.S. patent application Ser. No. 11/495,809 entitled "Frame Structure for a Collapsible Box with Top Access, Side Access, and Interconnected Vertical Stacking", filed Jul. 28, 2006, now U.S. Pat. No. 7,337,914, which is a continuation-in-part ("CIP") of U.S. patent application Ser. No. 11/452,146 filed Jun. 13, 2006, which is a continuation of U.S. patent application Ser. No. 10/245,643 filed Sep. 16, 2002, now U.S. Pat. No. 7,083,061 issued Aug. 1, 2006 (hereinafter "the '061 Patent"). This application also claims priority on and to U.S. patent application Ser. No. 11/436,307 filed May 18, 2006 and to U.S. Provisional Patent Application Ser. Nos. 60/323,045; 60/327,116; 60/683,542; 60/683,497; and 60/717,393 filed Sep. 17, 2001; Oct. 4, 2001; May 20, 2005; May 20, 2005; and Sep. 15, 2005, respectively. The specification, drawings, and teachings of the identified prior disclosures are incorporated herein by reference.

BACKGROUND

The '061 Patent discloses a collapsible box comprising, amongst other things, a pair of inner sidewalls (301) and a pair of outer sidewalls (102). Each of said inner sidewalls (301) is primarily comprised of a single solid panel. Said solid panels provide strength, and prevent said outer sidewalls (102) from folding or collapsing when the box is supporting a load on its top lid. Each of said inner sidewalls (301) stands adjacent to, and on the interior side of, a respective outer sidewall (102).

The present invention is directed to utilizing a lightweight frame structure in lieu of the solid inner sidewalls (301) of the device of the '061 Patent. Said frame structure allows for a variety of improvements, including reductions in production cost, weight and material, as well as elimination of parts and enhanced ease of usage and storage.

SUMMARY

In certain embodiments, the frame structure of the present invention comprises a pair of opposed arches which are vertical when the box of the present invention is in its open position. Each arch of said pair stands adjacent to, and on the interior side of, a respective outer sidewall. As disclosed in the '061 Patent, the outer sidewalls comprise upper and lower panels which are capable of folding inwardly along a hinge that runs horizontally through its center.

The frame structures disclosed herein provide the same amount of load bearing capacity as the solid inner sidewalls of the devices of the '061 Patent, while consuming significantly less thickness and surface area than said sidewalls. In most practical applications, the frame structures would consume about ⅓ the thickness and $1/10^{th}$ the surface area of the solid inner sidewalls.

The first embodiment of the present invention discloses a particular "single-hinge" design which requires fewer hinges than the "double-hinge" design disclosed in the '061 Patent. Such single-hinge design takes advantage of the aforementioned reduction in thickness. Furthermore, two particular "platform structures" necessary to the design disclosed in the '061 Patent are eliminated by the new design of the first embodiment.

A second embodiment disclosed herein, discloses a synthesis in which the frame structure is utilized in conjunction with the double-hinge design of the device of the '061 Patent. Such double-hinge design also takes advantage of the aforementioned reduction in thickness to eliminate both of the aforementioned platforms.

A third embodiment discloses a particular "channel structure" that takes advantage of the aforementioned reduction in surface area to enable a single-hinge design. Similar to the first embodiment, the third embodiment requires fewer hinges than the double-hinge design set forth in the device of the '061 Patent and eliminates the aforementioned "platform structures". Accordingly, the first and third embodiment disclose means by which the platform structures and certain hinges of the '061 Patent are eliminated; the second embodiment discloses a means by which said platform structures are eliminated.

The aforementioned new improvements regarding reductions in thickness, surface area, hinges and platforms are significant. Also, said frame structures can be manufactured from a variety of materials. Such materials include metal and high strength plastic, which would be too heavy or expensive, or both, to be feasible with the solid inner sidewalls of the device shown in the '061 Patent.

A fourth embodiment enhances the basic frame structure of the first embodiment. Such embodiment extends the frame structure to the exterior sides of the outer sidewalls, thereby increasing both dimensionality and strength. Such increases make it possible to create the outer sidewalls from soft fabric as an alternative to the rigid plastic from which they are commonly made.

BRIEF DESCRIPTION OF THE DRAWINGS

FIG. 2A shows the "single-hinge" design of the first embodiment, in which one hinge is utilized to attach both the frame structure and the outer sidewall to the box. FIG. 2B shows the "double-hinge" design of the device of the '061 Patent in which two different hinges are utilized to attach the inner sidewall and outer sidewall to the box. FIG. 2C shows the aforementioned synthesis of the second embodiment, in which the frame structure of the present invention is utilized in conjunction with the double-hinge design of the device of the '061 Patent.

FIG. 4A shows said channels; FIG. 4B shows the frame structures snapped or held inside said channels.

DETAILED DESCRIPTION OF THE INVENTION, THE PREFERRED EMBODIMENT, AND THE DRAWINGS

Figure 1A:
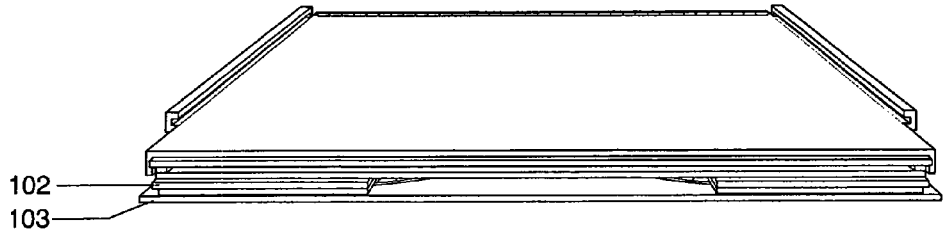
FIGS. 1A thru 1E are front perspective views showing the successive stages in which the box of the present invention progresses from closed to partially open to fully open position. However, in FIGS. 1A thru 1E of the present invention, inner sidewalls 301 of the '061 Patent are replaced by frame structures 701*a* (hatch marked for ease of illustration).
Figure 1B:
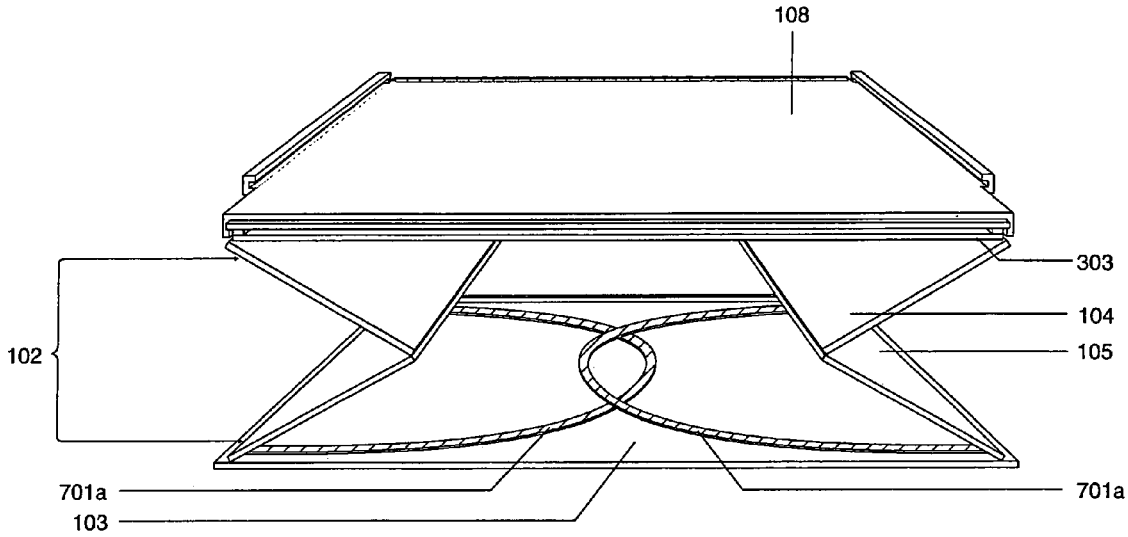

The basic description and drawings of the invention disclosed in U.S. Pat. No. 7,083,061 are incorporated herein by reference. FIG. 1A shows the box of the present invention in a collapsed or closed position. FIG. 1B shows outer sidewalls (102) of said box about halfway upright, as said box progresses through the successive stages of going from closed to open position. Frame structures 701*a*, in the preferred embodiment, comprising inverted-U or arch shapes, are hinged at their bottom edges and initially lie on the floor of said box. Outer sidewalls 102 comprise hinged together upper and lower panels 104 and 105, respectively.

Figure 1C:
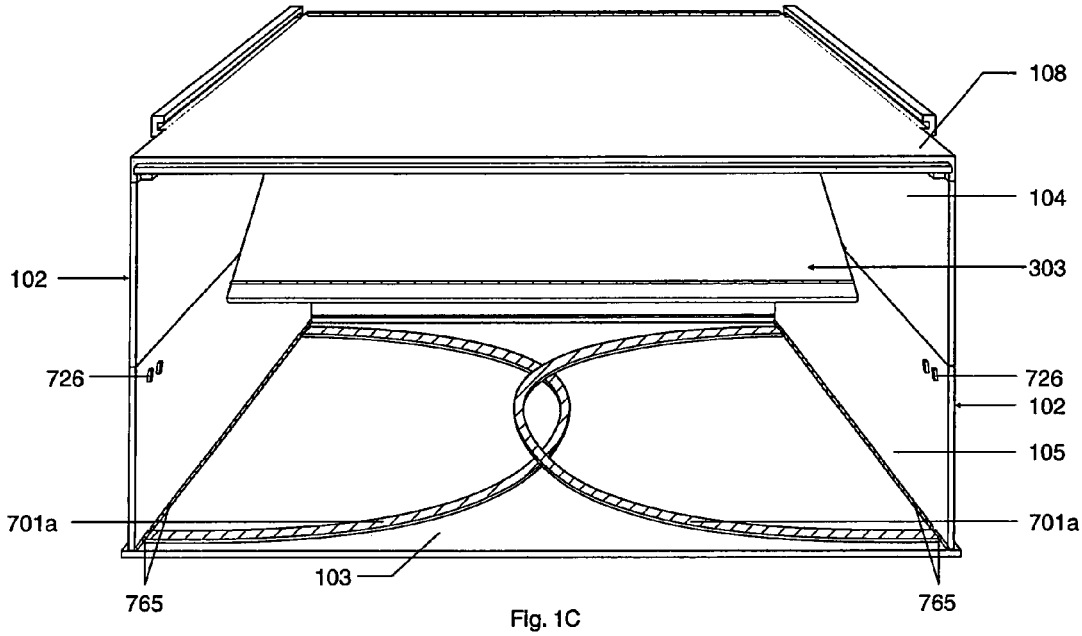
Figure 1D:
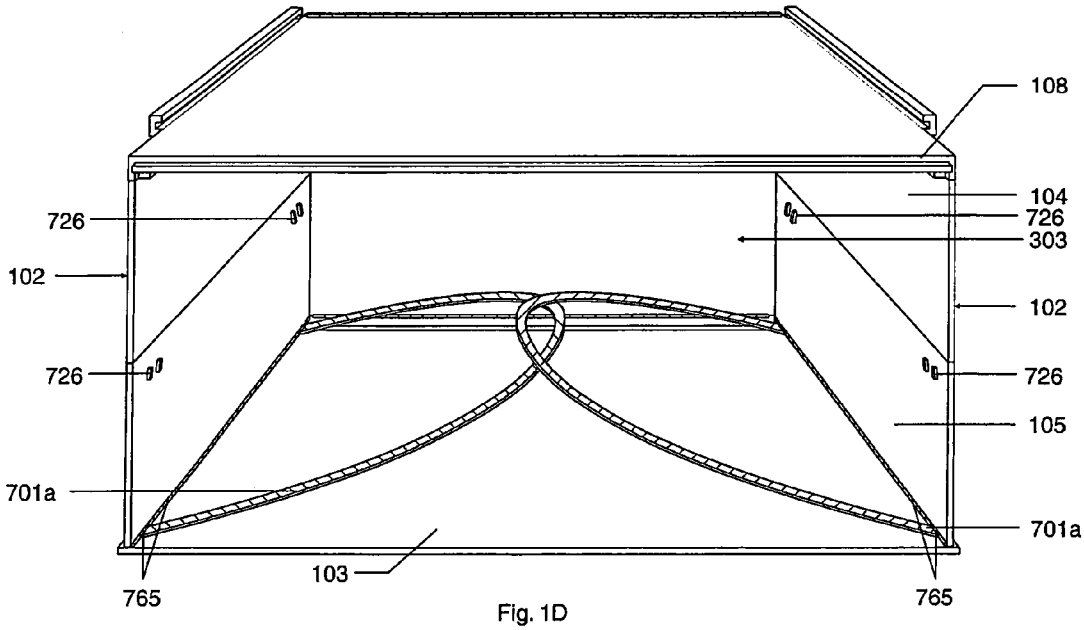
Figure 1E:
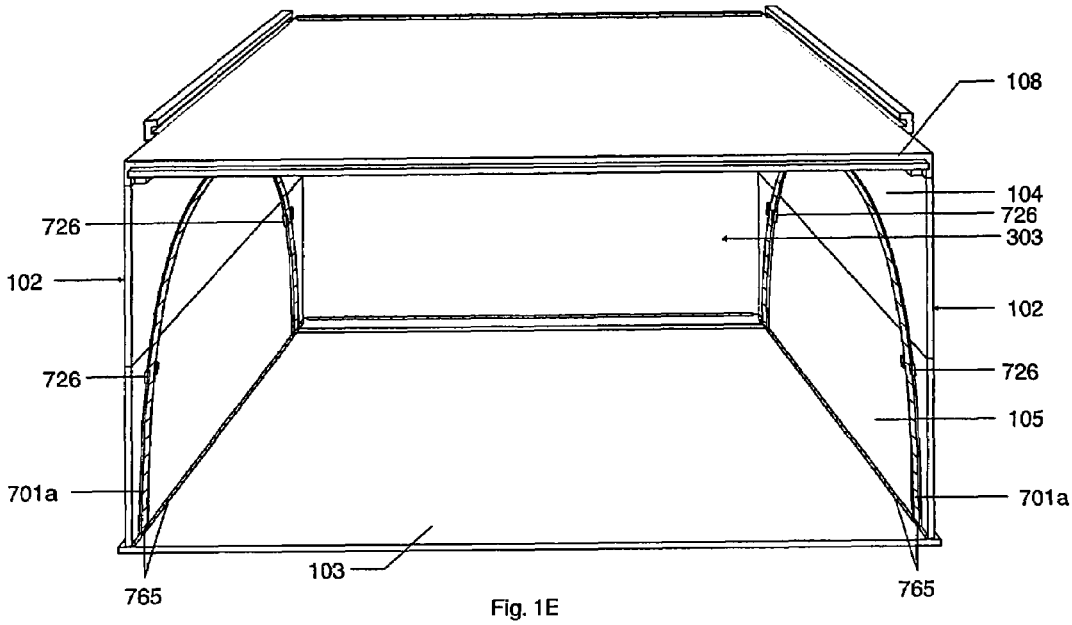
Figure 1F:
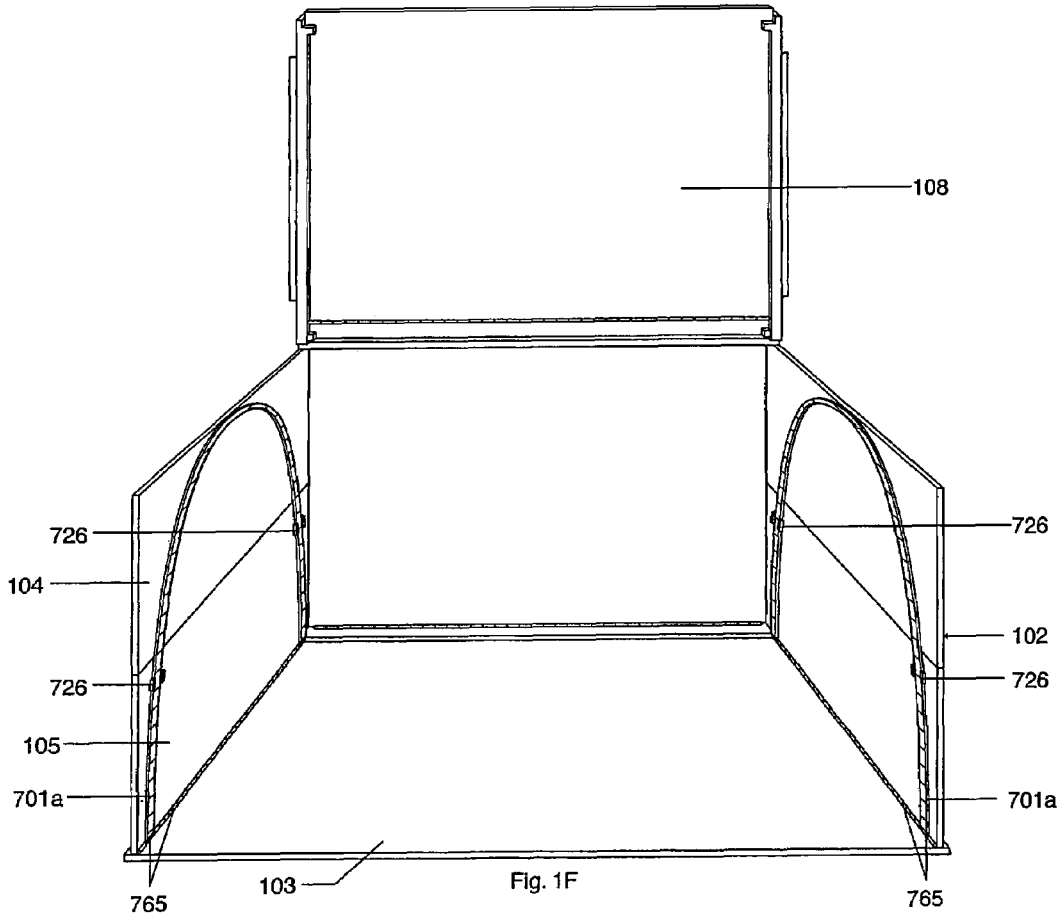
FIG. 1F shows the top lid of the box in an open position, thereby disclosing the full frame structure of the present invention.

FIG. 1C shows outer sidewalls (102) fully upright and back wall 303 hinged to the ceiling or top of the box and rotated about halfway downward, as said box further opens. Frame structures 701*a* can still be seen lying on the floor 103 of said box. FIG. 1D shows back wall 303 rotated fully downward with its flap received on top of the back edge of the floor 103. Here, frame structures 701*a* can be seen rotated about one-quarter of the way upward upon horizontally extending hinges 765. FIG. 1E shows both frame structures 701*a* in full upright position extending between the floor 103 and the inside ceiling along the inner and coplanar sidewalls, thereby providing load bearing support for boxes or other objects that may be placed on top lid 108. Prongs 726 resiliently flex outwardly and grasp said frame structures and hold them in position.

Figure 2A:
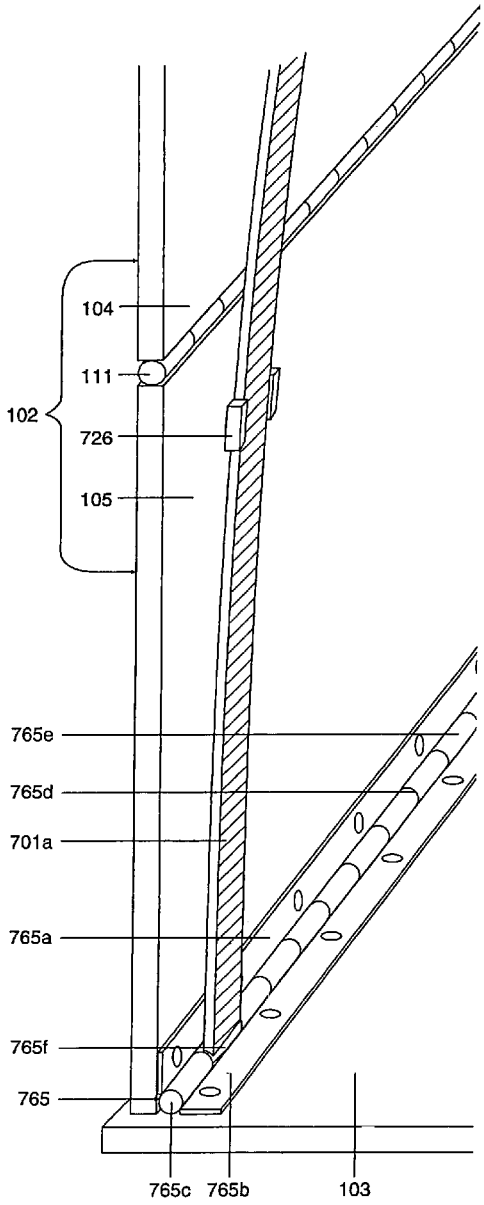
FIGS. 2A thru 2C are partial enlarged perspective views, showing only the left-side and floor of the box of the present invention. The right-side, lid and back wall have been eliminated to assist clarity of explanation.
Figure 3A:
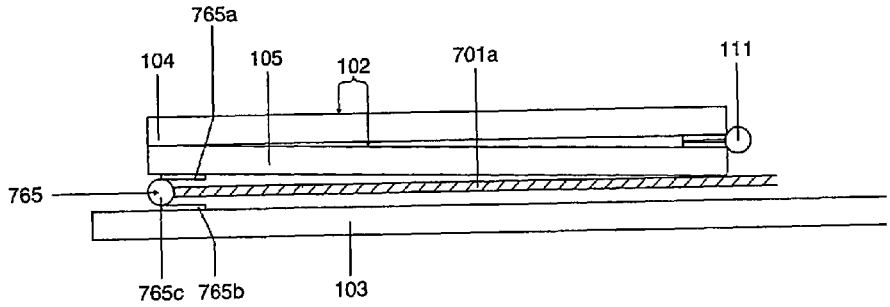
FIGS. 3A, 3B and 3C are partial frontal views showing FIGS. 2A, 2B and 2C, respectively, after the left sides of said boxes have been collapsed.

FIG. 2A shows the single-hinge design of the first embodiment in which both outer sidewall 102 and frame structure 701*a* are attached to hinge 765. Sidewall 102 is attached to the hinge via upper faceplate 765*a*. The frame structure 701*a* is attached to the hinge via "frame knuckles" 765*f*, which extend from the bottoms of the legs of said frame. The frame knuckles 765*f* and "regular knuckles" 765*e* comprise spine 765*d* of the hinge. Pin 765*c* runs thru the center of the spine. Floor 103 is attached to the hinge via a lower faceplate 765*b* whose knuckles are interleaved with those of the upper faceplate 765*a*. FIG. 3A shows the single-hinge design (with respect to the connection of the frames to the floor) when the left side of the box is in collapsed position. Frame 701*a* is hatch marked for ease of illustration.

Figure 2B:
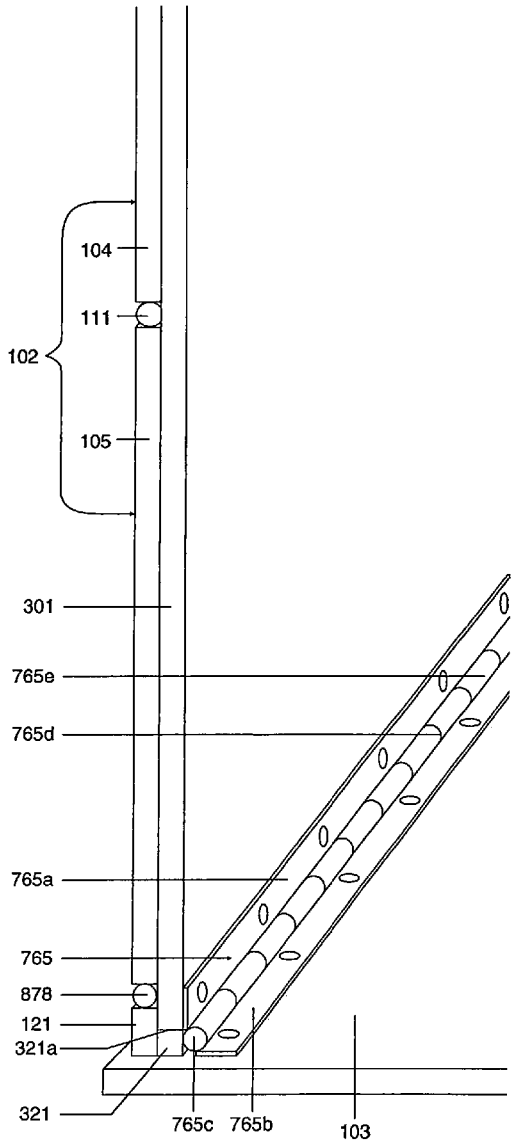
Figure 3B:
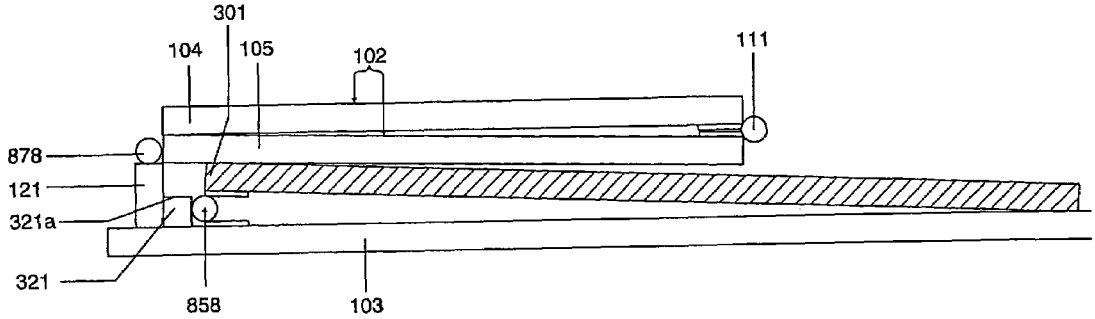

FIG. 2B shows the double-hinge design of the invention of the '061 Patent Application in which the outer sidewall and inner sidewall are attached and rotated by two different hinges. Outer sidewall 102 and solid inner sidewall 301 are secured to hinges 878 and 765, respectively. FIG. 3B shows this double-hinge design described in the '061 Patent when the left side of the box is in a collapsed position. Inner sidewall 301 is hatch marked for ease of illustration.

Figure 3C:
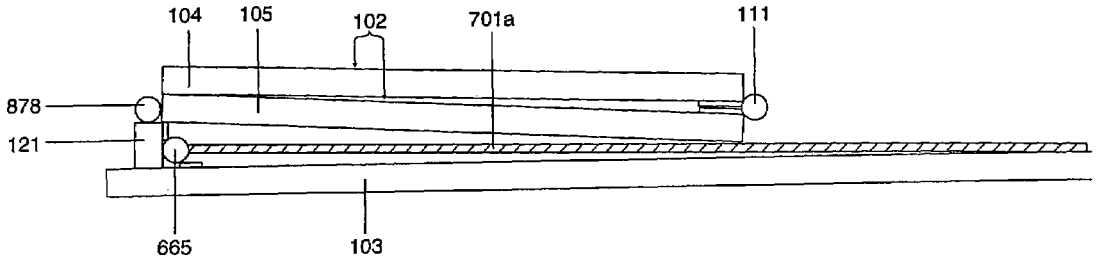
Figure 3D:
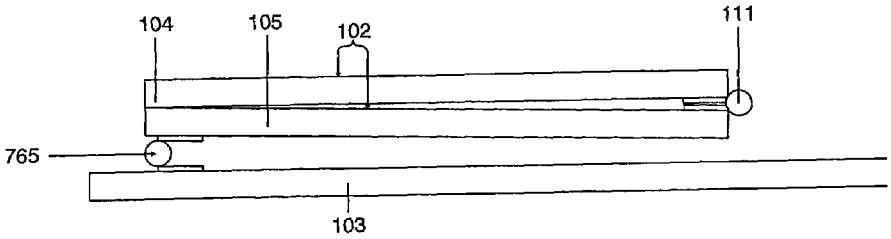
FIG. 3D is an explanatory aid, showing FIG. 3A without the frame structure.

Accordingly, the '061 Patent discloses a double hinge design, whereas the first embodiment of the present invention discloses a single hinge design, thereby eliminating a hinge from each of the left and right sides of the box. Such elimination is made possible by the relatively thin profile of the frame structure. As shown in FIG. 3D, hinge 765 affords an empty space between the floor of said box (103) and the lower panel of said sidewall (105). As shown in FIG. 3A, the relatively thin profile of frame 701*a* fits within such space, thereby allowing the frame and the outer sidewall to share a common hinge.

Such sharing would not be practical with the design of the '061 Patent, as the hinge would have to be unduly large to accommodate the thickness of the inner sidewall provided thereby. The double-hinge design shown in FIG. 14 of the '061 Patent, shows hinge 858 attached to the inner sidewall (on the right side of the box) and a separate hinge attached to the outer sidewall (on the left side of the box).

FIG. 2B further shows that outer sidewall 102 and inner sidewall 301 rest above platforms 121 and 321, respectively. Platform 121 raises the height or extension of the bottom of outer sidewall 102, so that said outer sidewall can fold over inner sidewall 301 about hinge 878. The platform 321 raises the height of inner sidewall 301, so that the bottom of said inner sidewall clears outer sidewall 102, when said inner sidewall rotates between open and collapsed positions upon hinge 765. Without platform 321, the bottom of inner sidewall 301 would abut said outer sidewall, thereby preventing rotation. The top surface of platform 321 is indicated by line 321*a*. FIG. 14 of the '061 Patent shows a platform beneath each of the outer and inner sidewalls.

The single-hinge design of the first embodiment of the present invention eliminates the need for both of the platforms, neither of which is shown, therefore, in FIGS. 2A or 3A. Accordingly, the present single-hinge design eliminates the need for two platforms and one hinge on each of the left and right sides of the box, as compared to the invention of the '061 Patent. This elimination is made possible by the relatively thin profile of the frame structure and would not be practical with the design of the box of the '061 Patent, due to the relatively thick profile of the inner sidewall shown therein.

Figure 2C:
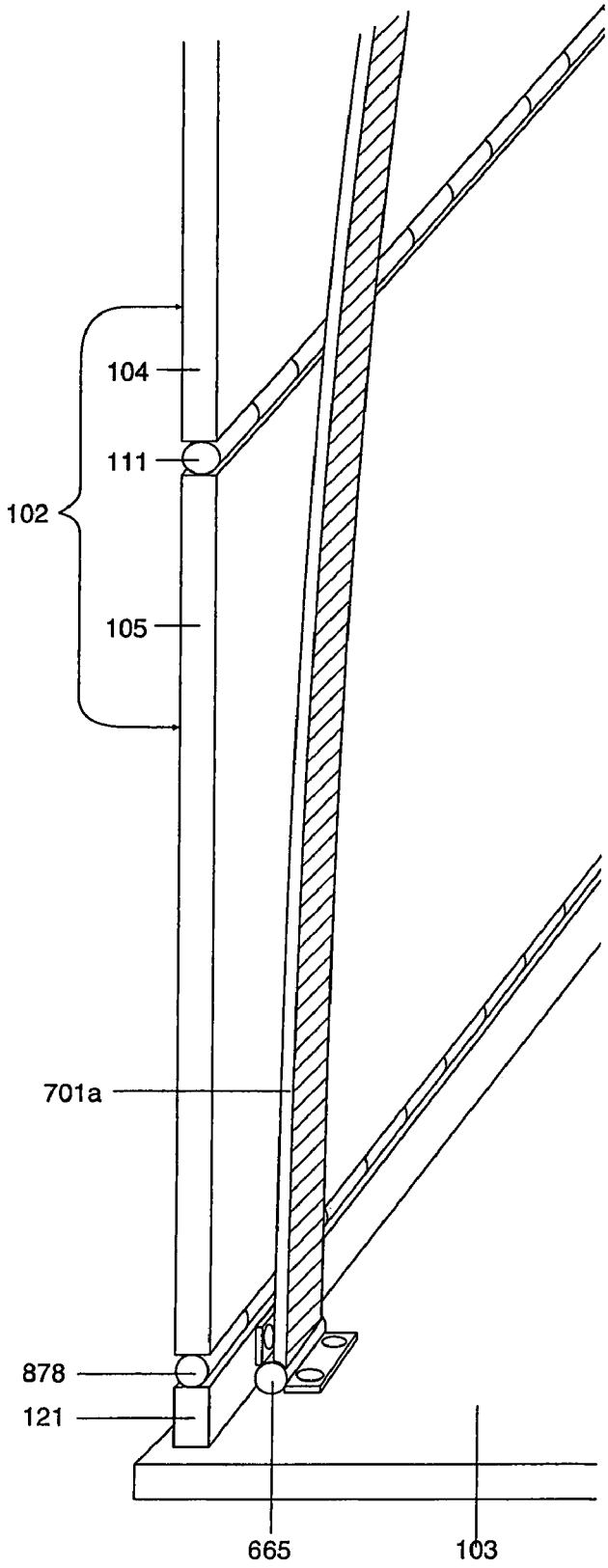

FIG. 2C shows the second embodiment, in which frame structure 701*a* of the present invention is utilized in conjunction with the double-hinge design of the device of the '061 Patent's device, thereby comprising a double-hinge design under the present invention. Outer sidewall 102 and frame structure 701*a* are attached to hinges 878 and 665, respectively. A separate hinge 665 is utilized to attach each of the front and back (not shown) legs of frame 701*a*, as opposed to FIGS. 2A and 2B in which one continuous, and wall length hinge (765) is utilized. FIG. 3C shows the double-hinge design of the present invention when the left side of the box is in a collapsed position. Frame 701*a* is hatch marked for ease of illustration.

As shown in FIGS. 2C and 3C, the outer sidewall rests above a platform 121, whereas the frame structure 701*a* rests above the floor of the box without an intervening or supporting/elevating platform. The outer sidewall is folded by hinge 111 and rests above a platform 121, whereas the frame structure 701*a* rests above the floor of the box without an intervening platform. Due to its relatively thin profile, the frame structure can rotate upon hinge 665 without requiring an underlying platform to raise its height in order for the lower portions of its legs to clear the outer sidewall during rotation. Accordingly, the double-hinge design of the second embodiment eliminates the need for one platform on each of the left and right sides of the box, as compared to the aforementioned double-hinge design of the '061 Patent which requires two platforms on each side of the box.

Figure 4A:
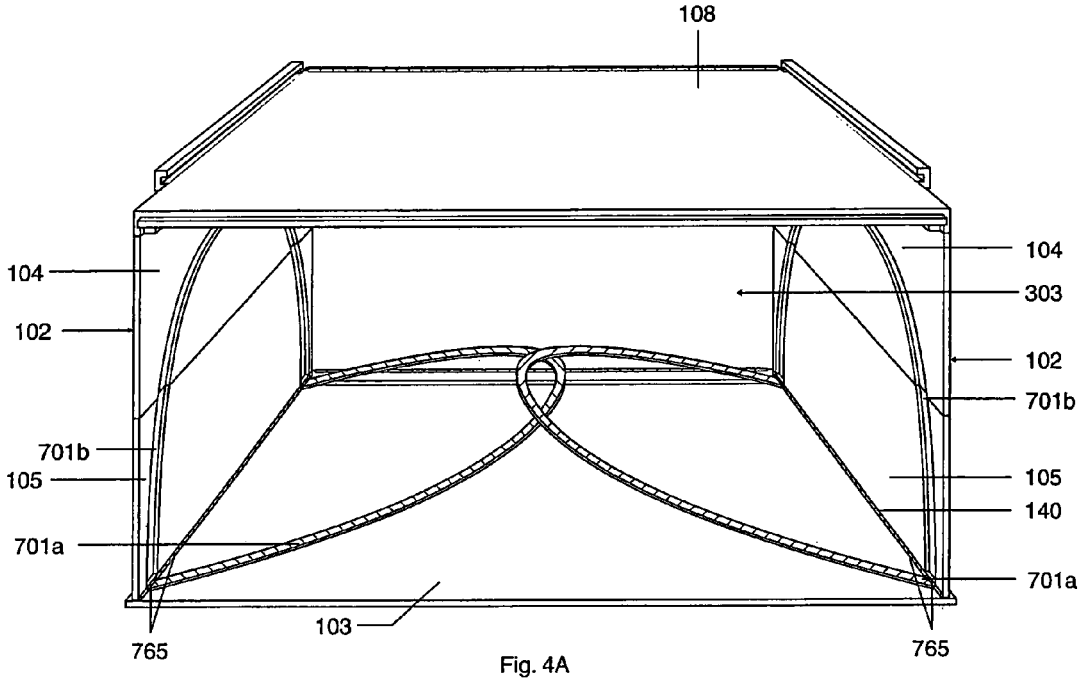
FIGS. 4A and 4B are front perspective views showing the third embodiment in which the inside surface of the outer sidewalls of the box contain grooved channels for receipt of the frames.
Figure 4B:
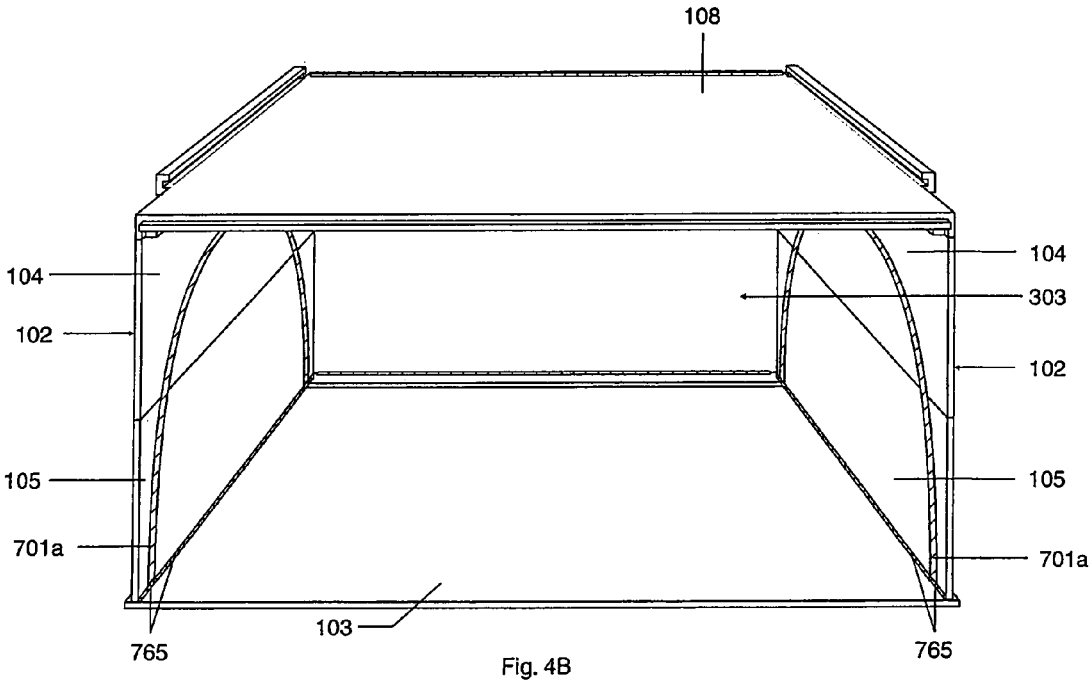

FIG. 4A shows the third embodiment in which outer sidewall 102 comprises an inside groove or channel 701*b*, the channel comprising a grooved or hollow shape that is configured to receive and frictionally or snugly hold frame structure 701*a*. FIG. 4A shows frame 701*a* about one-quarter rotated upright; FIG. 4B shows said frame structure 701*a* in full upright position and housed inside channels 701*b*. When the box is in its collapsed position, the lower portion of the frame structures will fit inside the channel within lower panel 105, thereby allowing the outer sidewall to fold in half and over the frame.

The grooved channel of the third embodiment discloses an alternative means of eliminating both the platform (121) and hinge (878) of the device shown in the '061 Patent. The ability of a frame to fit within a channel is made possible by the relatively small amount of surface area consumed by the frame.

Each of the-aforementioned reductions in weight, thickness, platform(s), hinge(s) and material consumption achieved by the present frames structure, as compared to the solid inner sidewalls of the device disclosed in the '061 Patent is significant. Accordingly, significant advantages are attained from both the fundamental properties of the frame (weight, thickness and material) and resulting structural differences in design (elimination of hinges and platforms and the use of channels).

Figure 5A:
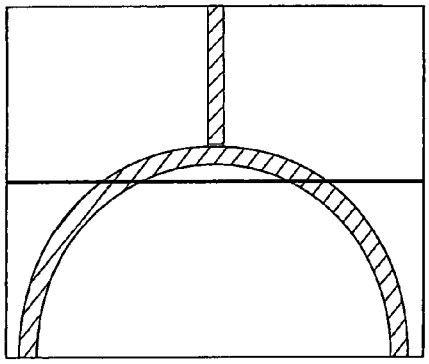
FIGS. 5A thru 5F are plan views of various alternative configurations of the frame structures and the inside of the sidewalls.
Figure 5B:
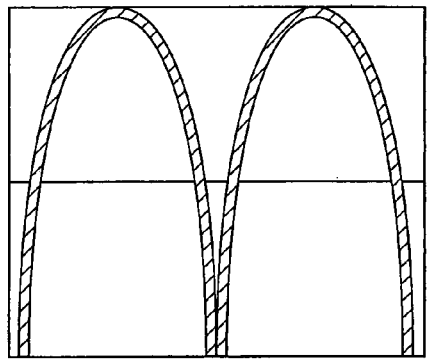
Figure 5C:
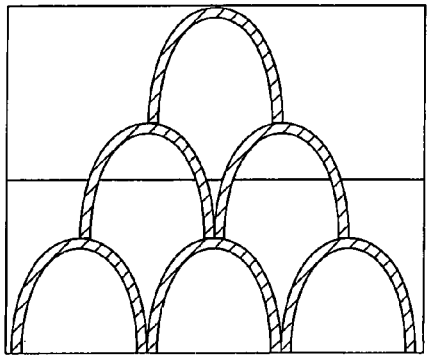
Figure 5D:
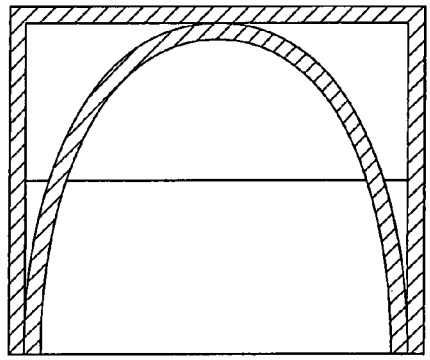
Figure 5E:
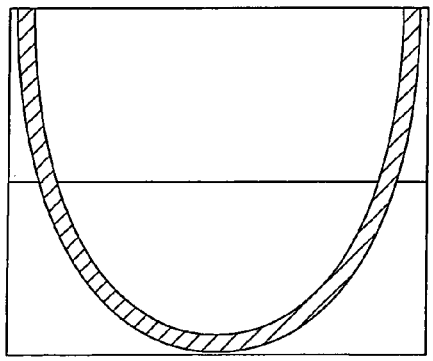
Figure 5F:
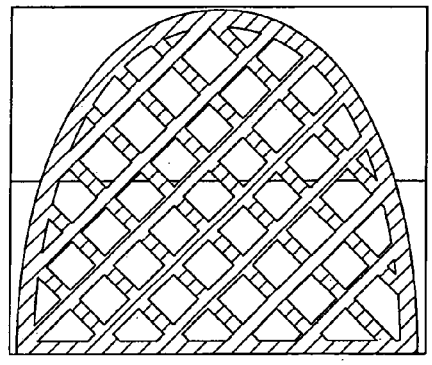

The frame structures of the aforementioned embodiments are in the shape of an arch. FIG. 5A shows an arch-and-post structure in which a bar-shaped vertical post rises from the top of an arch of smaller relative height, i.e., the top curve of the arch extends to a point lower than the other embodiment of the arch which shows the top curve of the arch to touching the top edge of the outer wall. Stated another way, the full-sized arch extends from the bottom to the top of the outer wall while the embodiment of the device shown in FIG. 5A has the arch with legs touching the bottom edge of the outer wall but the top edge of the arch is between the bottom edge of the top flap but below the top edge of the top flap, the balance of the overall height of the outer wall being made up by the bar-shaped vertical post. The height of the arch and the post are equal to the arch alone of the device shown in FIGS. 1B thru 1F, and 4A and 4B. FIGS. 5B and 5C show a (i) double or side-by-side arch structure and (ii) a pyramid of arches, respectively. FIGS. 5D and 5E show an arch within a rectangle and an inverted arch, respectively. FIG. 5F shows an arch perimeter shape with a mesh network inside it. Many other frame shapes and configurations are possible including, without limitation, various polygons, circles, semi-circles, vertical posts, horizontal pillars, open shapes, closed shapes and wave-like shapes. All are intended to provide strength and structure to maintain the outer wall of the box in its open position.

A frames structure could be alternatively attached near the top of the box rather than the bottom. The box disclosed in the '061 Patent discloses top attachment of the solid inner sidewalls. With top attachment in a frame structure, reductions in thickness, weight and cost comparable to those discussed above can still be achieved.

Figure 6:
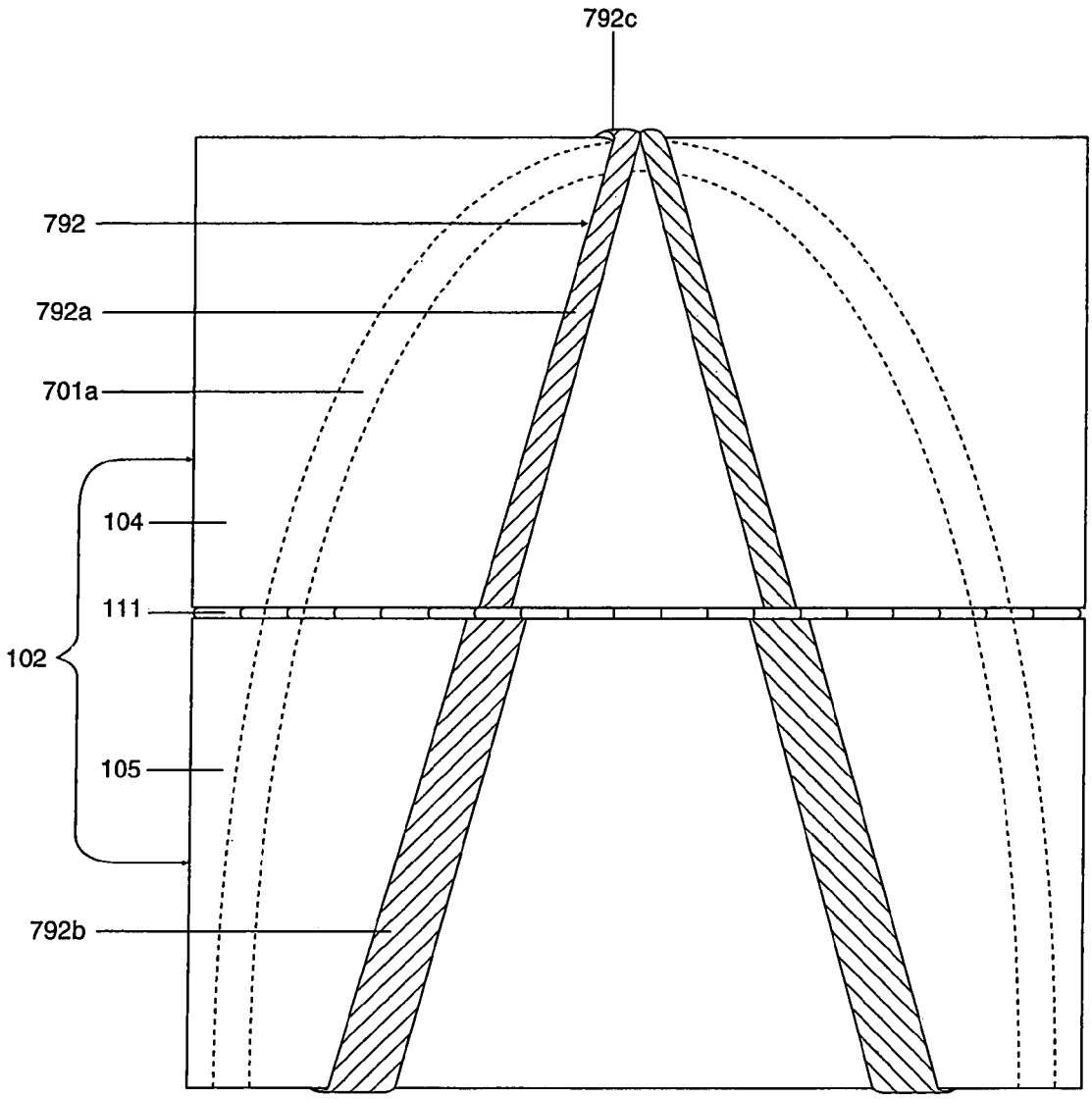
FIG. 6 is an enlarged frontal view of the exterior side of an outer sidewall, showing the fourth embodiment in which a frame is attached to the exterior side of the outer sidewall and connected to the interior frame of the first and third embodiments.

FIG. 6 shows a another embodiment comprising a rigid, preferably strong plastic frame structure 792 on the exterior of outer sidewall 102. This frame structure comprises upper and lower sections 792*a* and 792*b*, attached to upper and lower sidewall panels 104 and 105, respectively. The upper and lower wall panels are separated by hinge 111, the hinge comprising points along its length at which the wall panels are attached to it. Clasp 792*c* at the top of frame 792 is capable of grasping the top of frame 701*a* (shown by dashed lines), positioned on the interior side of the sidewall. The exterior frame structure disclosed in this Figure increases stability and strength, making it feasible to construct the outer sidewalls from alternative materials, such as soft fabric, in addition to rigid plastic and other commonly used materials.

In the aforementioned embodiments, the frame structure is hinged at it legs and the top of the arch is oriented at the top or ceiling of the box. In alternative embodiments, the structure could be variously hinged at its arch and/or the arch could be oriented with its crest directed at the bottom of the box. The aforementioned grooved channel of the third embodiment could, alternatively, be positioned in the floor of the box rather than on the sidewall. The frame structure of the first and third embodiments could be positioned on the exterior side of the sidewalls, rather than on the interior side as shown in the embodiments.

While the above description contains many specificities, these should not be construed as limitations on the scope of the invention, but rather as exemplifications of one or more embodiments thereof. Other variations and embodiments are possible. Those who are skilled in the art will readily perceive how to modify the invention. Therefore, the appended claims are to be construed to cover all equivalent structures which fall within the true scope and spirit of the invention and should not be limited to the embodiments illustrated.

We claim:

1. A collapsible box comprising:

a set of interconnected walls that form a top lid, a floor, a backwall hingedly attached to one of said top lid or said floor, a pair of opposed vertical sidewalls each comprising a set of upper and lower panels, said upper and lower panels attached to each other via a horizontally extending hinge upon which said panels pivot about an axis to form said vertical sidewalls when the box is in its set-up configuration;

a pair of opposed frame support structures, said frame support structures being selectively movable between a first position substantially flat against inner faces of said vertical sidewalls when said box is in its set-up configuration and a second position hinged substantially parallel with either the top or bottom of said box when said box is in its collapsed configuration;

an open space at the front side of said box allowing frontal access to an interior space within said box, wherein said box is substantially flat when in said collapsed configuration and substantially rectangular when in said set-up configuration.

2. A collapsible box comprising:

a set of interconnected walls that form a pair of opposed vertical sidewalls each comprising a set of upper and lower panels, said upper and lower panels attached to each other via a horizontally extending hinge upon which said panels pivot about an axis to form said vertical sidewalls when the box is in its set-up configuration;

a pair of opposed frame support structures, said frame support structures being selectively movable between a first position substantially flat against inner faces of said vertical sidewalls when said box is in its set-up configuration and a second position hinged substantially parallel with either the top or bottom of said box when said box is in its collapsed configuration;

an open space at the front side of said box allowing frontal access to an interior space within said box, wherein said box is substantially flat when in said collapsed configuration and substantially rectangular when in said set-up configuration, and wherein said frame structures comprise arch shapes.

3. A collapsible box comprising:

a set of interconnected walls that form a pair of opposed vertical sidewalls each comprising a set of upper and lower panels, said upper and lower panels attached to each other via a horizontally extending hinge upon which said panels pivot about an axis to form said vertical sidewalls when the box is in its set-up configuration;

a pair of opposed frame support structures, said frame support structures being selectively movable between a first position substantially flat against inner faces of said vertical sidewalls when said box is in its set-up configuration and a second position hinged substantially parallel with either the top or bottom of said box when said box is in its collapsed configuration;

an open space at the front side of said box allowing frontal access to an interior space within said box, wherein said box is substantially flat when in said collapsed configuration and substantially rectangular when in said set-up configuration, said vertical sidewalls further comprising grooves into which said frame structures are disposable when said box is in said set-up configuration.

4. A collapsible box comprising:

a set of interconnected walls that form a pair of opposed vertical sidewalls each comprising a set of upper and lower panels, said upper and lower panels attached to each other via a horizontally extending hinge upon which said panels pivot about an axis to form said vertical sidewalls when the box is in its set-up configuration;

a pair of opposed frame support structures, said frame support structures being selectively movable between a first position substantially flat against inner faces of said vertical sidewalls when said box is in its set-up configuration and a second position hinged substantially parallel with either the top or bottom of said box when said box is in its collapsed configuration;

an open space at the front side of said box allowing frontal access to an interior space within said box, wherein said box is substantially flat when in said collapsed configuration and substantially rectangular when in said set-up configuration, and wherein each of said frame support structures is hingedly attached at one end substantially at an edge between two adjacent orthogonal surfaces of said interconnected walls.

5. A collapsible box according to claim 4, wherein each of said frame support structures is hingedly attached at one end at an edge between one of said vertical sidewalls and either said upper or lower panel.

* * * * *